US008590827B2

(12) United States Patent
Sparks

(10) Patent No.: US 8,590,827 B2
(45) Date of Patent: Nov. 26, 2013

(54) RIJKE TUBE CANCELLATION DEVICE FOR HELICOPTERS

(75) Inventor: David Sparks, Fort Worth, TX (US)

(73) Assignee: Textron Innovations Inc., Providence, RI (US)

( * ) Notice: Subject to any disclaimer, the term of this patent is extended or adjusted under 35 U.S.C. 154(b) by 152 days.

(21) Appl. No.: 13/227,231

(22) Filed: Sep. 7, 2011

(65) Prior Publication Data

US 2013/0056581 A1 Mar. 7, 2013

(51) Int. Cl.
*G10K 11/00* (2006.01)
*G10K 11/175* (2006.01)

(52) U.S. Cl.
USPC ..... 244/1 N; 244/17.13

(58) Field of Classification Search
USPC ..... 244/1 N, 17.11, 17.13, 129.1; 181/206; 701/528; 381/164; 116/DIG. 22
See application file for complete search history.

(56) References Cited

U.S. PATENT DOCUMENTS

| | | | | |
|---|---|---|---|---|
| 2,836,033 | A * | 5/1958 | Marrison | 116/DIG. 22 |
| 3,685,610 | A | 8/1972 | Bschorr | |
| 6,198,991 | B1 * | 3/2001 | Yamakawa et al. | 244/17.13 |
| 7,584,028 | B2 * | 9/2009 | Burnside | 244/188 |
| 2005/0098681 | A1 * | 5/2005 | Berson et al. | 244/1 N |
| 2006/0111818 | A1 * | 5/2006 | Ishii et al. | 701/3 |
| 2010/0220876 | A1 * | 9/2010 | Aarts et al. | 381/164 |

OTHER PUBLICATIONS

Matveev, K., 2003. Thermoacoustic Instabilities in the Rijke Tube: Experiments and Modeling, PhD Thesis, Caltech. Available online from http://thesis.library.caltech.edu/859/1/matveev_thesis.pdf.*

Zealand, K., 2006. Problem No. 11: Singing tube, 19th IYPT. Available online from http://archive.iypt.org/solutions/.*

Extended European Search Report from the European Patent Office in corresponding European Application No. 11189425.9; dated Feb. 22, 2012.

"Generation of Harmonics in a Rijke Tube by Using a Single Heating Element", Collyer A A et al, Journal of Sound and Vibration, 1973, 27(2), pp. 275-277.

"On the Spectral Characteristics of a Self-Excited Rijke Tube Combustor—Numerical Simulation and Experimental Measurements", Prateep Chatterjee, Journal of Sound and Vibration; 2005; pp. 573-588.

"Definition of Heater Location to Drive Maximum Amplitude Acoustic Oscillations in a Rijke Tube", Carvalho J. A., Combustion and Flame, 76: 17-27, 1989.

* cited by examiner

*Primary Examiner* — Tien Dinh
*Assistant Examiner* — Richard R Green
(74) *Attorney, Agent, or Firm* — James E. Walton; J. Oliver Williams

(57) ABSTRACT

An acoustic signature reduction system for application typically on an aircraft. The acoustic signature reduction system uses a controller, power supply, and a thermo-acoustic tube such as a Rijke tube or Sondhauss tube to generate a cancellation noise of equal amplitude and inverted to that of noise generated by rotor blades when rotating. Acoustic signature reduction system can use a damping valve to make an intermittent cancellation sound to match the n/rev signature of the rotor blades with respect to a given reference location. The n/rev timing is different depending on the reference location therefore a cone of silence is created. A forced air unit may also be used to modify the phase of the cancellation noise in order to move the cone of silence around the aircraft.

20 Claims, 8 Drawing Sheets

RIJKE TUBE CANCELLATION DEVICE FOR HELICOPTERS

BACKGROUND

1. Field of the Invention

The present application relates in general to helicopter acoustics, in particular, to the reduction of a helicopter acoustic signature.

2. Description of Related Art

Efforts to curtail the sound produced by aircraft, such as helicopters, has been a focus for many years. Helicopters produce sound from the engine and transmission as well as sound from compression waves generated by the passing of each rotor blade.

Efforts to address the sound of helicopters have typically been in one of two areas. First, efforts regarding noise cancellation have been directed to the cabin of the helicopter. This would typically involve the use of sound deadening materials and insulation layers. Such efforts generally look to insulate cabin passengers from rotor blade noise rather than reducing helicopter acoustic signature.

Secondly, efforts have been made in the area of helicopter noise reduction. Noise reduction has typically come via advancements in blade design by minimizing main or tail rotor tip speed, for example. Other efforts have included ducted tail rotors or other blade symmetry alterations. These particular techniques often require overall design changes to rotor geometry, power, avionics, and transmission, and generally cannot be made after the helicopter has completed production. Also, such efforts are primarily concerned with noise reduction rather than noise cancellation.

None of these methods or efforts fully addresses cancellation of the acoustic signature of a helicopter, therefore considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
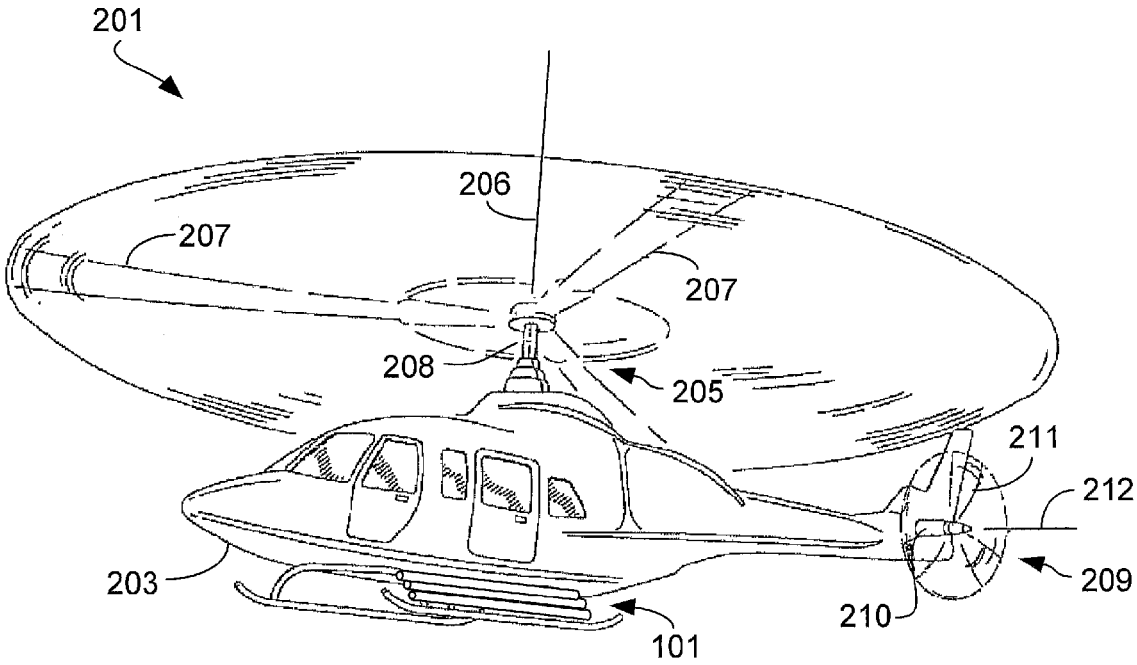
FIG. 1 is an oblique view of a helicopter with an acoustic signature reduction system according to the preferred embodiment of the present application.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

Referring to FIG. 1 in the drawings, an aircraft, such as a helicopter 201, having an acoustic signature reduction system 101 is illustrated. Helicopter 201 has a body 203 and a main rotor assembly 205, including main rotor blades 207 and a main rotor shaft 208. Helicopter 201 has a tail rotor assembly 209, including tail rotor blades 211 and a tail rotor shaft 210. Main rotor blades 207 generally rotate about a longitudinal axis 206 of main rotor shaft 208. Tail rotor blades 211 generally rotate about a longitudinal axis 212 of tail rotor shaft 210. Helicopter 201 also includes acoustic signature reduction system 101 according to the present disclosure for canceling the acoustic signature generated by main rotor blades 207 and tail rotor blades 211.

Figure 2:
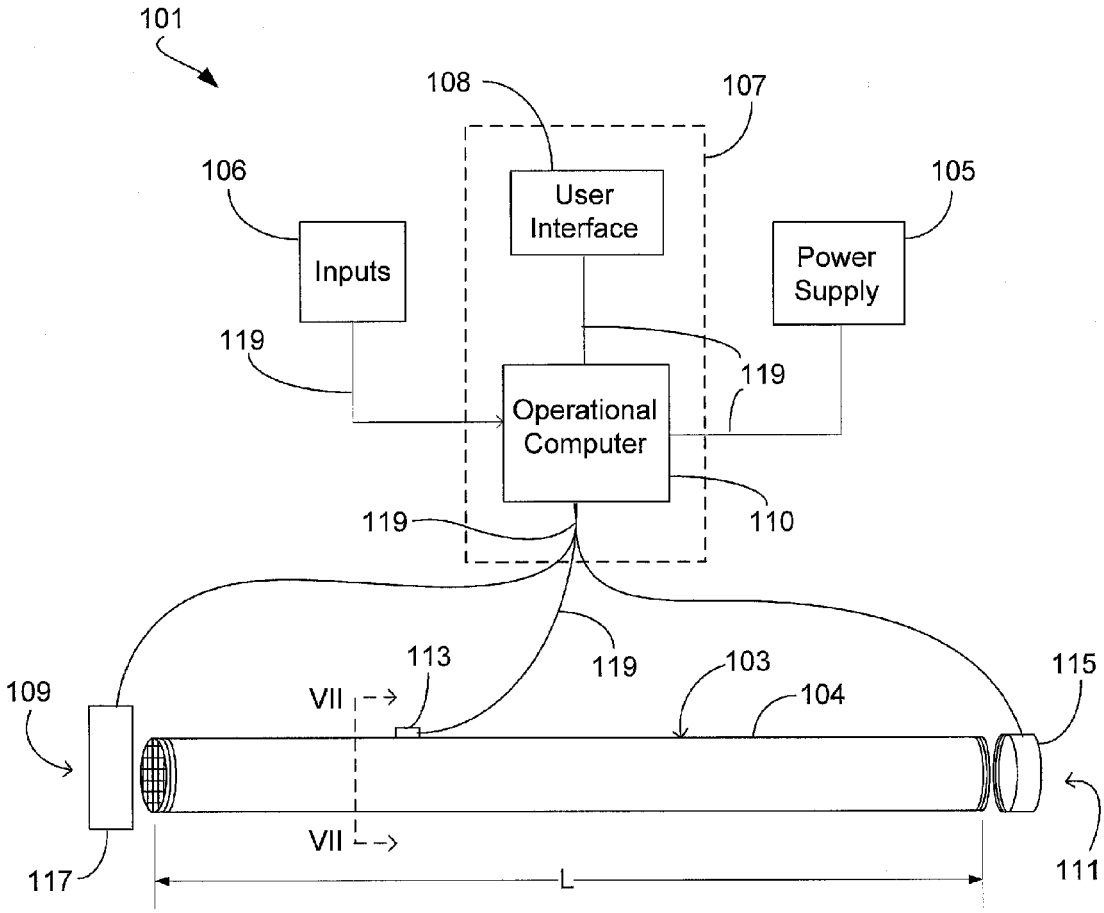
FIG. 2 is the acoustic signature reduction system of FIG. 1.

Referring now also to FIG. 2 in the drawings, an acoustic signature reduction system 101 of the present application is illustrated. Acoustic signature reduction system 101 contains a number of devices such as a thermo-acoustic tube 103, a power supply 105, and a controller 107. In alternate embodiments, acoustic signature reduction system 101 may also include the following devices: a mechanical damping valve 115 and/or a forced air unit 117. Wires 119 are coupled to the above mentioned devices and serve to provide electrical power and operational control throughout acoustic signature reduction system 101.

Acoustic signature reduction system 101 is used to reduce the acoustic signature of aircraft preferably having well defined low frequency noise that is produced while the aircraft is in operation. Such aircraft may be a plane, a helicopter, a tilt rotor, or an unmanned aerial vehicle, for example. For purposes of this application, the preferred embodiment will involve reducing the acoustic signature of helicopter 201, and in particular rotor blades 207, 211.

Thermo-acoustics typically refers to the creation of sound in a device due to the transfer of energy from a thermal energy source. Acoustic signature reduction system 101 is configured to generate a cancellation noise of a selected frequency and amplitude. The amplitude and frequency is chosen based on the amplitude and frequency of a compression noise generated by rotor blades 207, 211 while rotating. The compression noise is generally the first noise heard by an observer of an approaching helicopter. Acoustic signature reduction system 101 creates out-of-phase "anti-noise", or cancellation noise, through thermo-acoustic tube 103. This "anti-noise" is used to cancel out or significantly reduce the fundamental frequencies and the associated harmonics of the compression noise. In practice, the cancellation noise must be of the same amplitude but with an inverted phase, thereby creating a phase cancellation effect. Where the phase is inverted but the amplitude is not equal, a reduced cancellation effect is generally observed. Although described as canceling out the compression noise, it is understood that typically the cancellation noise generated by acoustic signature reduction system 101 is generally sufficient to reduce the compression noise to a sound level relatively equal to that of the engine and transmission rather than completely canceling out the compression noise. However it is understood that acoustic signature reduction system 101 is capable of generating cancellation noises of any amplitude and frequency to produce a desired cancellation effect. In doing so, acoustic signature reduction system 101 primarily operates with very low and defined frequencies rather than broadband frequencies.

Examples of thermo-acoustic tube 103 are a Rijke tube or a Sondhauss tube; to name a few. For purposes of this application, discussion of thermo-acoustic tube 103 will revolve around the use of a Rijke tube. Though a Rijke tube is used, it is understood that other thermo-acoustic tubes may be applied and used in acoustic signature reduction system 101. Thermo-acoustic tube 103 typically includes a strait hollow cylindrical pipe portion or pipe 104 having a length L. Pipe 104 has a forward end 109 and an aft end 111. Thermo-acoustic tube 103 also includes a heating element 113. Forward end 109 is typically upstream from aft end 111. Both forward end 109 and aft end 111 are typically open so as to allow air to flow through pipe 104. When air flows through thermo-acoustic tube 103, the air is heated by heating element 113, thereby creating an acoustic instability. Large pressure amplitudes at selected frequencies are generated. Although pipe 104 is described as having two open ends, it is understood that thermo-acoustic tube 103 may have one or more ends closed.

Figure 3:
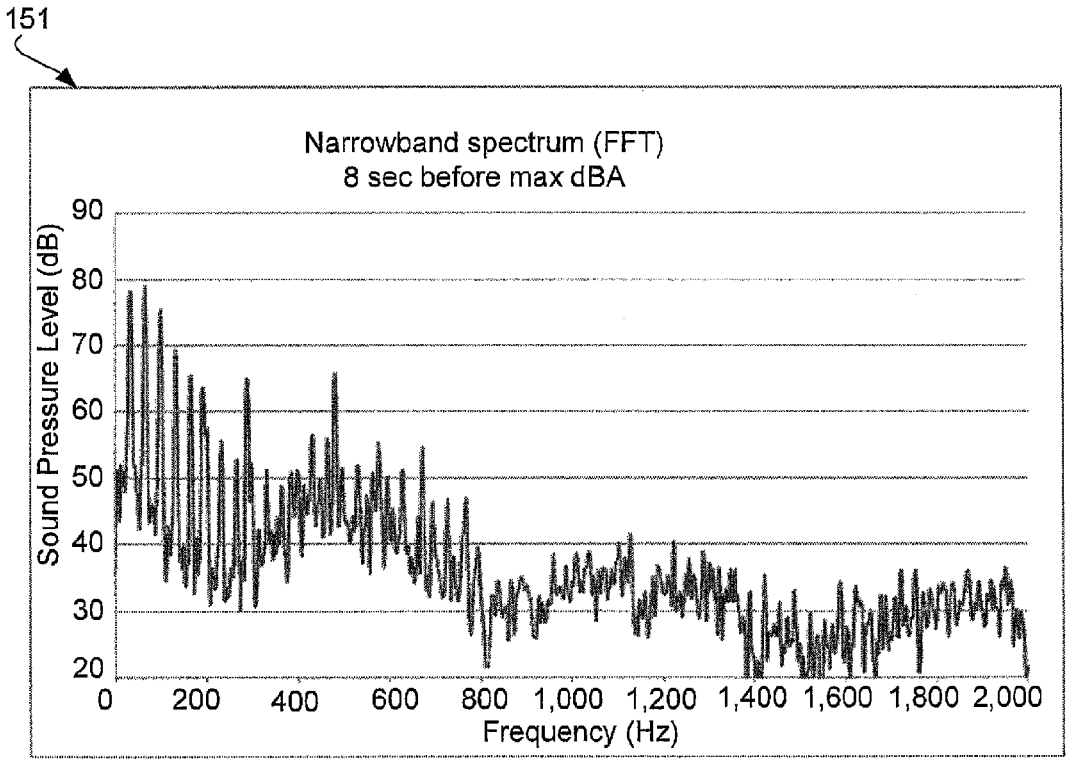
FIG. 3 is a chart showing the amplitude and frequency of rotor blade noise according to the preferred embodiment of the present application.
Figure 4:
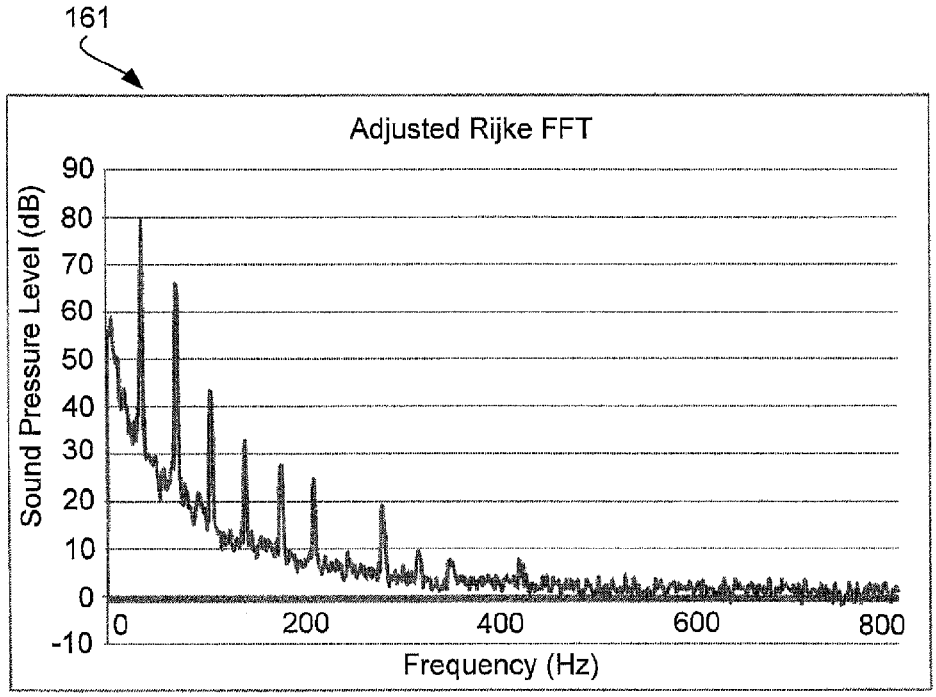
FIG. 4 is a chart showing the amplitude and frequency of a thermo-acoustic tube such as a Rijke tube according to the preferred embodiment of the present application.

Referring now also to FIGS. 3 and 4 in the drawings, charts depicting the frequency spectrum of helicopter 201 and a Rijke tube respectively are illustrated. Chart 151 shows the sound characteristics generated by helicopter 201 while blades 207, 211 are rotating. Chart 151 compares the frequency of the compression wave to the sound pressure in decibels (dB). Chart 161 likewise compares the same parameters as in chart 151, but with regard to the sound characteristics of a Rijke tube. Chart 151 and chart 161 illustrate that a Rijke tube, or thermo-acoustic tube 103, can produce harmonic frequencies of similar amplitude and frequency to that of rotor blades 207, 211. The harmonic frequencies are denoted by the spikes in decibels particularly at low frequencies. The distinct low frequency and high amplitude noise is being referred to as a harmonic frequency.

The number of harmonic frequencies produced by helicopter 201 and a Rijke tube are different. As seen from chart 151 for example, three pressure spikes above 70 decibels were generated whereas chart 161 shows only one was generated by the Rijke tube. The number of harmonic frequencies produced by a Rijke tube above 40 decibels is fewer than that produced by helicopter 201. Therefore, to counter the many harmonics generated by rotor blade 207, 211 compression noise, a series of thermo-acoustic tubes 103 will typically be required. An object of the present application will be to reduce the noise generated by rotor blades 207, 211 to a level comparable to that of the frequency and amplitude levels produced by the engine, transmission, and other workings of the aircraft. Additionally, in order to increase the amplitude of thermo-acoustic tube 103, it can be necessary to stack or bunch multiple thermo-acoustic tubes 103 together as seen in FIG. 5.

Thermo-acoustic tube 103 can operate much like a musical instrument wherein the combination of several factors can adjust the frequency and amplitude of the sound generated. For instance, the amount of air flow and the temperature of heating element 113 can affect the amplitude. Likewise, typically the location of heating element 113 within thermo-acoustic tube 103 and the length and diameter of pipe 104 can affect the frequency produced. Much like a musical instrument, thermo-acoustic tube 103 can typically "play" a selected set of harmonic frequencies depending on the arrangement and size of thermo-acoustic tube 103.

Figure 5:
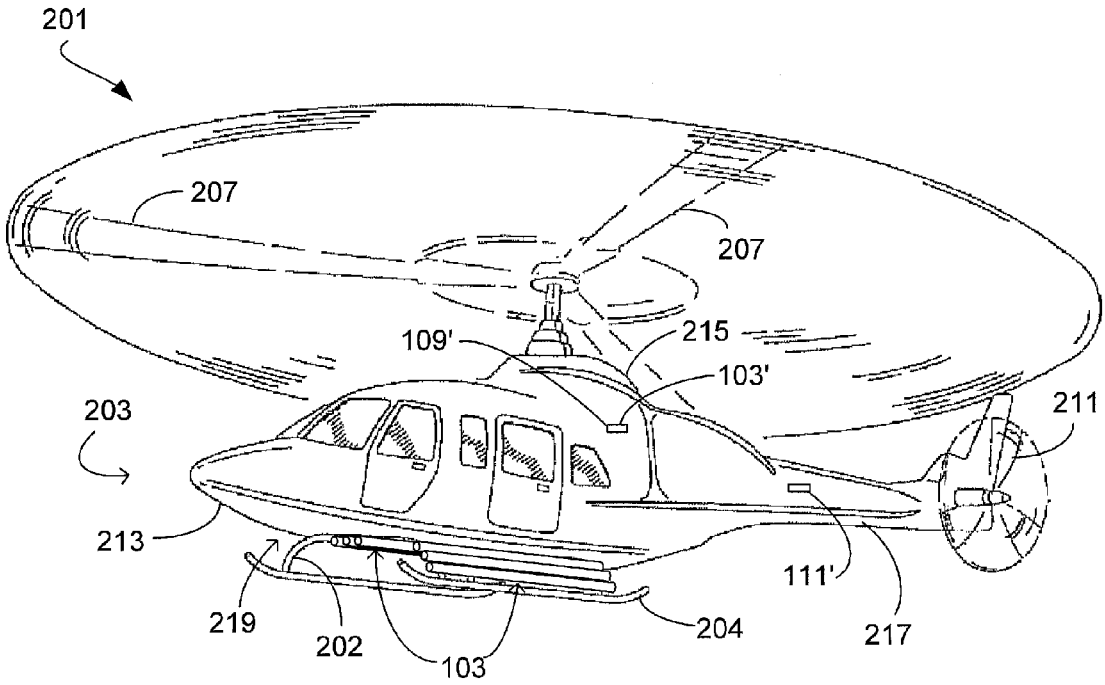
FIG. 5 is an oblique view of the helicopter of FIG. 1 having multiple thermo-acoustic tubes coupled to the helicopter.

Referring now also to FIG. 5 in the drawings, thermo-acoustic tube 103 of the present application is illustrated in multiple locations on helicopter 201. Helicopter 201 has a landing strut 202, a skid 204, and a body 203. Body 203 typically includes a fuselage 213, an engine cowl 215, an empennage 217, and a wing (not shown), for example. It should be understood that body 203 is not limited to only those parts of helicopter 201 listed. Thermo-acoustic tube 103 is typically coupled to some external portion of helicopter 201. For example, thermo-acoustic tube 103 may be coupled to a landing strut 202 or externally to a bottom portion 219 of fuselage 213. Acoustic signature reduction system 101 is configured to be easily installed on aircraft during production or after production as a retrofit, for example. The time of installation can affect the location of thermo-acoustic tubes 103 and, in general, the features of acoustic signature reduction system 101.

Although described as being coupled externally to helicopter 201, it is understood that other embodiments can couple thermo-acoustic tube 103 to helicopter 201 such that a portion of thermo-acoustic tube 103 is located internally to helicopter 201. For example, thermo-acoustic tube 103 may be located internally within body 203 as seen with thermo-acoustic tube 103'. Thermo-acoustic tube 103' has a forward end 109' and an aft end 111' protruding externally to body 203. All other portions of thermo-acoustic tube 103' are illustrated internally to body 203.

Thermo-acoustic tube 103 may be coupled to helicopter 201 by multiple methods. For example, thermo-acoustic tube 103 may be coupled to helicopter 201 by the use of fasteners such as clamps, threaded fasteners, clips, or pins to name a few. Furthermore, welding or riveting may be used. Additionally, in the preferred embodiment, thermo-acoustic tube 103 is typically oriented such that the plane of forward end 109 is perpendicular to the front of helicopter 201. It is understood that forward end 109 and aft end 111 are not limited to being oriented in such a way. In other embodiments, forward end 109 and aft end 111 may be oriented such that the plane of forward end 109 or aft end 111 is not perpendicular to the front of helicopter 201. Furthermore, other embodiments may permit thermo-acoustic tubes 103 to swivel or translate on or within helicopter 201.

Although pipe 104 has been described as having a circular cross-sectional shape, it is understood that pipe 104 can have any profile shape, such as circular, square, or octagonal to name a few. Furthermore, although pipe 104 has been described as being strait, it should be understood that pipe 104 may have one or more curves or bends along the longitudinal axis.

Figure 6:
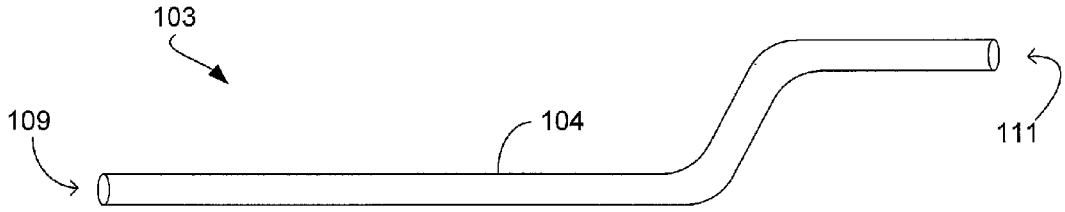
FIG. 6 is a side view of the thermo-acoustic tube as seen in FIG. 2 having one or more bends.

Referring now also to FIG. 6 in the drawings, pipe 104 of FIG. 2 is illustrated with a curved shape having one or more bends along the axial length. As stated above, pipe 104 of thermo-acoustic tube 103 can vary in length and diameter in order to play certain harmonic frequencies. Depending on the frequency and amplitude, pipe 104 may have a diameter of one or two inches and a length up to 23 feet, for example. The size of thermo-acoustic tube 103 can limit suitable locations to secure thermo-acoustic tube 103 to helicopter 201, thereby resulting in acoustic signature reduction system 101 being limited to a narrower range of machinery. Therefore, an alternate embodiment of pipe 104 may have a curved shape with one or more bends. By designing pipe 104 with a curved shape, the relative length of pipe 104 is generally maintained but the effective size can be substantially smaller, thereby fitting a broader range of aircraft.

This curved shape allows for thermo-acoustic tube 103 to couple to helicopter 201 in a greater number of locations. For example, thermo-acoustic tube 103 can be located within and follow the contour of body 203 as shown in FIG. 5. Thermo-acoustic tube 103 may even be incorporated into existing parts of helicopter 201. For example, skids 204 or landing struts 202 are typically hollow tubes. Thermo-acoustic tube 103 may be formed by creating openings, forward end 109 and aft end 111, to allow air to flow through skid 204. Heating element 113 can then be located inside skid 204. In addition, although thermo-acoustic tube 103 has been described as coupled to helicopter 201, it is understood that other embodiments may permit thermo-acoustic tube 103 to be rotatably coupled to helicopter 201 allowing thermo-acoustic tube 103 to rotate and/or swivel in relation to helicopter 201 as mentioned previously. Although described in certain locations and embodiments, it is understood that thermo-acoustic tube 103 may be coupled to helicopter 201 in multiple other locations not described herein.

Figure 7:
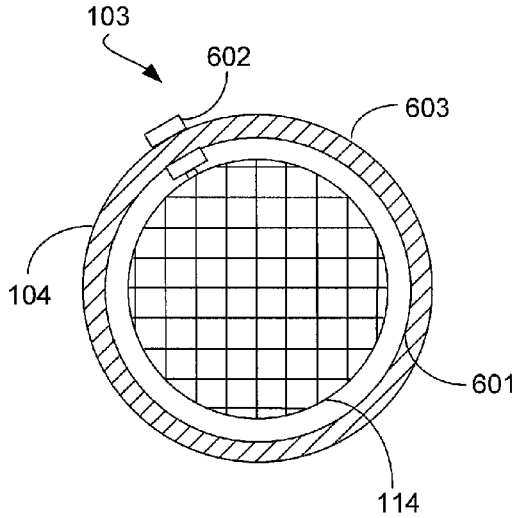
FIG. 7 is a section view of the inside the thermo-acoustic tube of FIG. 2 showing a heating element.
Figure 8:
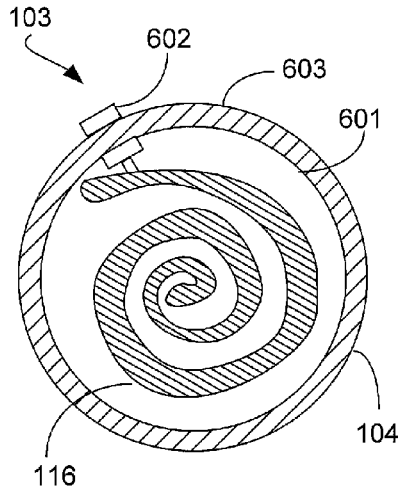
FIG. 8 is a section view inside the thermo-acoustic tube of FIG. 2 showing a different embodiment of the heating element.

Referring now also to FIGS. 7 and 8 in the drawings, a cross sectional view of pipe 104 showing heating element 113 coupled to pipe 104 is illustrated without wires 119. Heating element 113 is typically a resistor coupled to pipe 104 by the use of fasteners 602. When an electrical current is received, heating element 113 converts the electrical current to heat. However, heating element 113 is not limited to just using electrical energy to create heat. Other methods of generating heat are understood and permissible so long as the functions of thermo-acoustic tube 103 are retained, namely generating sound. As air passes through pipe 104, heating element 113 is configured to heat the air. As heated air travels from heating element 113 and exits aft end 111, a sound wave is produced resulting in a cancellation noise of a certain amplitude and frequency. As mentioned previously, each thermo-acoustic tube 103 generally has a set of harmonic frequencies. The location of heating element 113 helps determine which harmonic frequency is generated.

Typically heating element 113 is located a predetermined distance along the axis of pipe 104 from forward end 109. The distance is generally between L/4 to L/3 where L refers to the length of pipe 104. Heating element 113 is generally positioned having at least a portion of heating element 113 located inside pipe 104 and oriented such that the plane of heating element 113 is relatively perpendicular to the flow of air. Heating element 113 is coupled to pipe 104 by use of fasteners 602 such as clamps, threaded fasteners, clips, or rivets; to name a few. In the preferred embodiment, heating element protrudes through an aperture (not shown) in pipe 104 at some defined location and is coupled to an internal surface 601 and an external surface 603 of pipe 104. In the preferred embodiment, rotational and translational movement of heating element 113 is restricted. Where pipe 104 has an aperture (not shown) produced from heating element 113 protruding through pipe 104, typically a sealant (not shown) is used to ensure no air leaks through the aperture.

Wires 119 are coupled to heating element 113 as seen in FIG. 2. Wires 119 carry an electrical current from controller 107 to fluctuate the temperature of heating element 113. By changing the temperature of heating element 113, the amplitude of the sound produced can be altered. Although wires are depicted in FIG. 2 as connecting to heating element 113 outside of pipe 104, it is understood that wires 119 may be located on or around any portion of pipe 104. For example, wires 119 may travel and be coupled to internal surface 601.

Heating element 113 may take any number of shapes and sizes. In the preferred embodiment, heating element 113 is a metallic wire mesh 114 as seen in FIG. 7. However, other embodiments may shape heating element 113 as a metallic coil 116 as seen in FIG. 8, for example. The shape of heating element 113 is not limited to the examples presented. It is understood that other shapes can be used and create a functioning thermo-acoustic tube 103. Furthermore, heating element 113 is not limited to metallic materials. It is understood that any material may be used that permits for relatively quick and controlled temperature changes.

Furthermore, although heating element 113 has been described as being located internally to pipe 104 in a fixed location by use of fasteners 602, it should be understood that heating element 113 may be oriented and located in a multitude of positions with respect to pipe 104. For example, heating element 113 may be formed like a blanket wrapped around surface 601, 603 of pipe 104.

Figure 9:
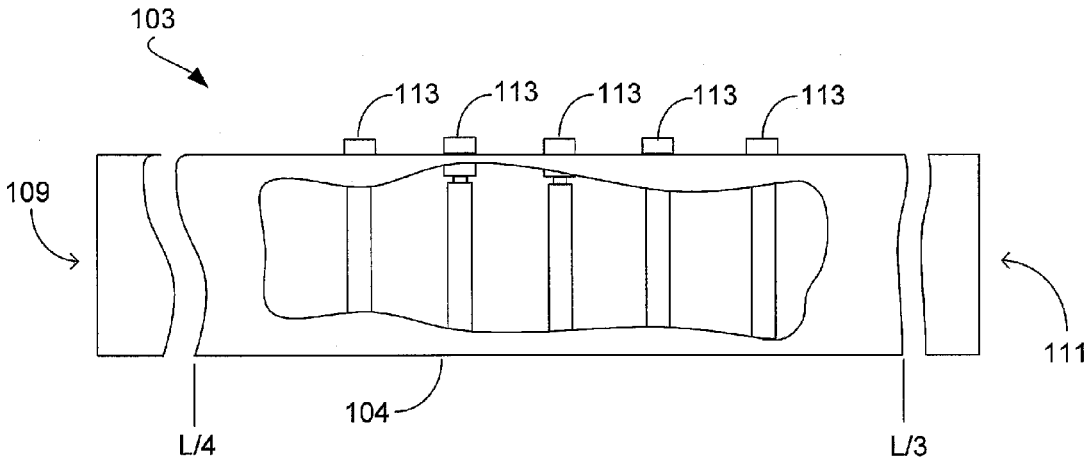
FIG. 9 is a breakout view of the in thermo-acoustic tube of FIG. 2 in an alternate embodiment having multiple heating elements.

Referring now also to FIG. 9 in the drawings, a breakout view of thermo-acoustic tube 103 having multiple heating elements inside pipe 104 is illustrated. As stated previously, the location of heating element 113 partially determines the frequency of the sound produced. In the preferred embodiment, one heating element 113 is used inside each pipe 104. However, in an alternate embodiment, more than one heating element 113 may be used in pipe 104. Each heating element 113 is located in a different location within pipe 104, thereby producing multiple harmonic frequencies. Where multiple heating elements 113 are used, multiple frequencies may be played simultaneously.

Figure 10:
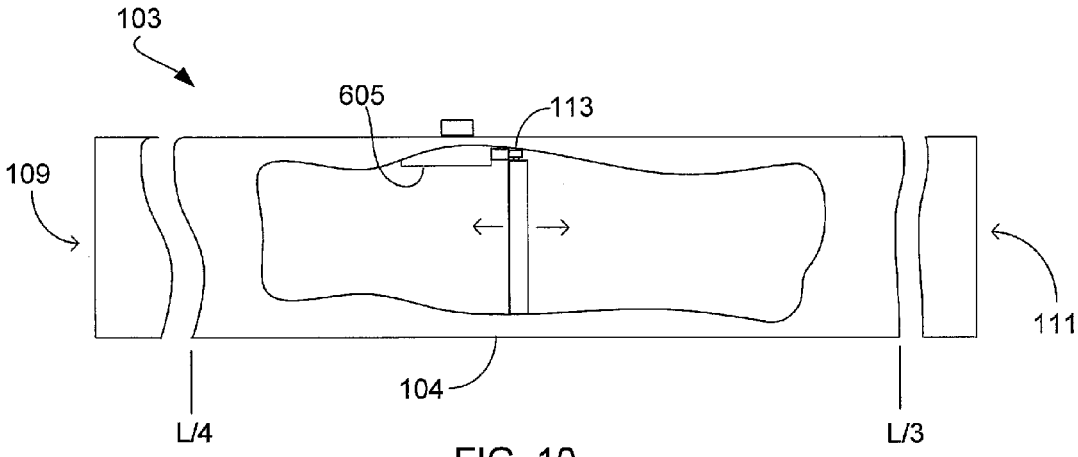
FIG. 10 is a breakout view of the thermo-acoustic tube of FIG. 2 in an alternate embodiment wherein a moveable apparatus translates the heating element along the axis of the thermo-acoustic tube.

Referring now also to FIG. 10 in the drawings, thermo-acoustic tube 103 having a moveable apparatus 605 coupled to heating element 113 is illustrated. Although the preferred embodiment prevents axial translation of heating elements 113, it is understood that an alternate embodiment of thermo-acoustic tube 103 may include moveable apparatus 605 that permits the axial translation of heating element 113 inside pipe 104. In such an embodiment, moveable apparatus 605 is coupled to pipe 104. Heating element 113 is then coupled to moveable apparatus 605 in a manner that permits movement of heating element 113. Such a configuration results in an adjustable heating element 113. Moveable apparatus 605 may be a motorized track or a solenoid, for example. The ability to translate within pipe 104 allows a single heating element 113 to produce multiple frequencies. However, a single heating element 113 could typically play one frequency at a time. Thermo-acoustic tube 103 may incorporate the use of one or more fixed and/or adjustable heating elements 113 within thermo-acoustic tube 103.

Referring back to FIG. 2 in the drawings, where controller 107 is illustrated. Controller 107 typically incorporates an operational computer 110 and a user interface 108. Controller 107 is operably connected to the various devices within acoustic signature reduction system 101 by wires 119.

Operational computer 110 receives multiple inputs. Operational computer 110 receives operational and environmental inputs 106 typically via existing systems within helicopter 201. Operational inputs can refer to helicopter 201 in particular, such as rotor blade pitch, helicopter speed, torque, blade speed, and so forth. Environmental inputs can refer to general environmental conditions such as air temperature, air density, elevation, and so forth. Inputs 106 are continuously transmitted to operational controller 110. Operational computer 110 uses inputs 106 to aid in operating acoustic signature reduction system 101.

Operational computer 110 also receives user inputs typically from a pilot (not shown) via a user interface 108. User interface 108 permits a user, such as a pilot to adjust acoustic signature reduction system 101. User interface 108 is typically an interactive digital device, such as a touch screen, for example, that provides a graphical view concerning the location of the aircraft in relation to other objects such as terrain, aircraft, structures, vehicles, and so forth. Typically, some of the features of user interface 108 may include a mapping function to illustrate these objects in relation to helicopter 201, the ability to zoom in and out on the screen, and the ability to select a "quiet zone" or a cancellation area 403 (see FIGS. 11 and 12) relative to helicopter 201. Cancellation area 403 can be selected to pertain to a specific location or to a specific object. Therefore, cancellation area 403 can be stationary or mobile. Controller 107 automatically adjusts the phase, amplitude, and frequency of the cancellation noise to compensate for relative motion between the aircraft and cancellation area 403.

It is understood that user interface is not limited to those features described above. Other features are known and possible that would aid the pilot in the quick detection and selection of cancellation area 403. User interface 108 also communicates to the pilot performance data of acoustic signature reduction system 101, such as cancellation effects, frequency, amplitude, and so forth. Cancellation effects refer to the resulting sound level, approximate size of cancellation area 403 given distance between cancellation area 403 and helicopter 201, and so forth. Though typically a touch screen device would be used, other methods of permitting pilot control are possible such as mechanical dials, for example. Likewise, though a pilot has been described as operating user interface 108, any member of a crew in helicopter 201 may use user interface 108. Any person interacting with user interface 108 may be termed a user of user interface 108 whether the person is the pilot, a crew member, or a remote person not on helicopter 201.

User interface 108 transmits a set of user commands from the pilot, typically via wires 119, to operational computer 110. Operational computer 110 simultaneously analyzes inputs 106 and the user commands from user interface 108. Operational computer 110 then transmits system commands to the various devices in acoustic signature reduction system 101 to generate a cancellation noise of selected amplitude, frequency, and phase needed to cancel out the compression noise relative to helicopter 201. Although wires 119 are described and the method of transmitting and communicating between devices within acoustic signature reduction system 101, other methods of transmitting signals such as wireless communications are possible.

In the preferred embodiment, operational computer 110 and/or user interface 108 is integrated within existing computers on helicopter 201 thereby reducing the weight required to install system 101 on helicopter 201. Likewise, inputs 106 are typically generated by existing sensors and software on helicopter 201 so as to decrease the weight and space required to implement acoustic signature reduction system 101. Although described as being integrated within existing systems on helicopter 201, it is understood that other embodiments permit operational computer 110 and/or user interface 108 to be a separate unit located on or off helicopter 201. For example, operational computer 110 and/or user interface 108 may be located remote to helicopter 201, such as on another aircraft, ground vehicle, structure, or ship, for example. In addition, acoustic signature reduction system 101 may also use additional sensors to gather inputs 106. By being independent and separate from existing systems on helicopter 201, acoustic signature reduction system 101 is adapted to be retrofitted to existing aircraft.

In embodiments where wireless connections are used, a user can be a remote person located remote to helicopter 201 may access and control any portion of acoustic signature reduction system 101. Typically, control from a remote location would occur in the use of remote flying aircraft, such as unmanned aerial vehicles, for example, but are not so limited. Wireless connections wherein controller 107 is remote to helicopter 201 would further help facilitate retrofitting aircraft with acoustic signature reduction system 101, generally needing only to update software on the existing aircraft.

Although controller 107 is described as including operational computer 110 and user interface 108, it is understood that either one may be removed. For example, where the noise to be cancelled consists of a constant phase, frequency, amplitude and timing; controller 107 can consist of only user interface 108 to turn the system on and off and select cancellation areas 403. However, the phase, frequency, amplitude, and timing of the compression noise generated by rotor blades 207, 211 are not always continuous. Rather, the compression noise is typically intermittent.

Where the sound to be canceled is continuous to all observers, a continuous cancellation noise is typically desired. Where the sound to be canceled is intermittent as to an observer, the cancellation noise typically needs to be intermittent as well. As each blade 207, 211 rotates past an observer, a distinct compression noise is heard. The per-revolution timing of the compression noise is a function of the number of rotor blades 207, 211 on helicopter 201.

The pressure amplitudes generated by thermo-acoustic tube 103 are typically continuous as long as air flows through pipe 104. Damping valve 115 is used to synchronize the cancellation noise generated by thermo-acoustic tube 103 with that of the compression noise as heard by an observer relative to helicopter 201. Operational computer 110 controls damping valve 115 depending on signals from user interface 108 and inputs 106. In the preferred embodiment, damping valve 115 is typically threadedly coupled about aft end 111 of thermo-acoustic tube 103. Thermo-acoustic tube 103 and damping valve 115 are secured by interference fit. However, it is understood that other methods of attaching damping valve 115 may be used such as fasteners, welding, or adhesive, for example. Damping valve 115 is configured to alter the rate of air passing through thermo-acoustic tube 103 by opening and/or closing aft end 111 of pipe 104.

By altering the air flow rate, damping valve 115 decreases the noise generated by thermo-acoustic tube 103 to a level at or below the noise level generated by other parts of helicopter 201 such as the engine and transmission. By repeatedly opening and closing damping valve 115, noise similar to that of rotor compression noise can be simulated. Damping valve 115 can therefore create an intermittent cancellation noise to match the per-revolution noise much like an observer would hear. Decreasing the cancellation noise between passing rotor blades 207, 211 prevents acoustic signature reduction system 101 from adding to the overall acoustic signature of helicopter 201.

Damping valve 115 can use one or more devices to alter the flow rate of air through thermo-acoustic tube 103 such as flaps, shutters, or nozzles to name a few. Although damping valve 115 is located about aft end 111 of thermo-acoustic tube 103, it is understood that damping valve 115 may be located anywhere along pipe 104. Furthermore, for aircraft having continuous amplitudes or frequencies to be canceled by acoustic signature reduction system 101, damping valve 115 may be removed.

Figure 11:
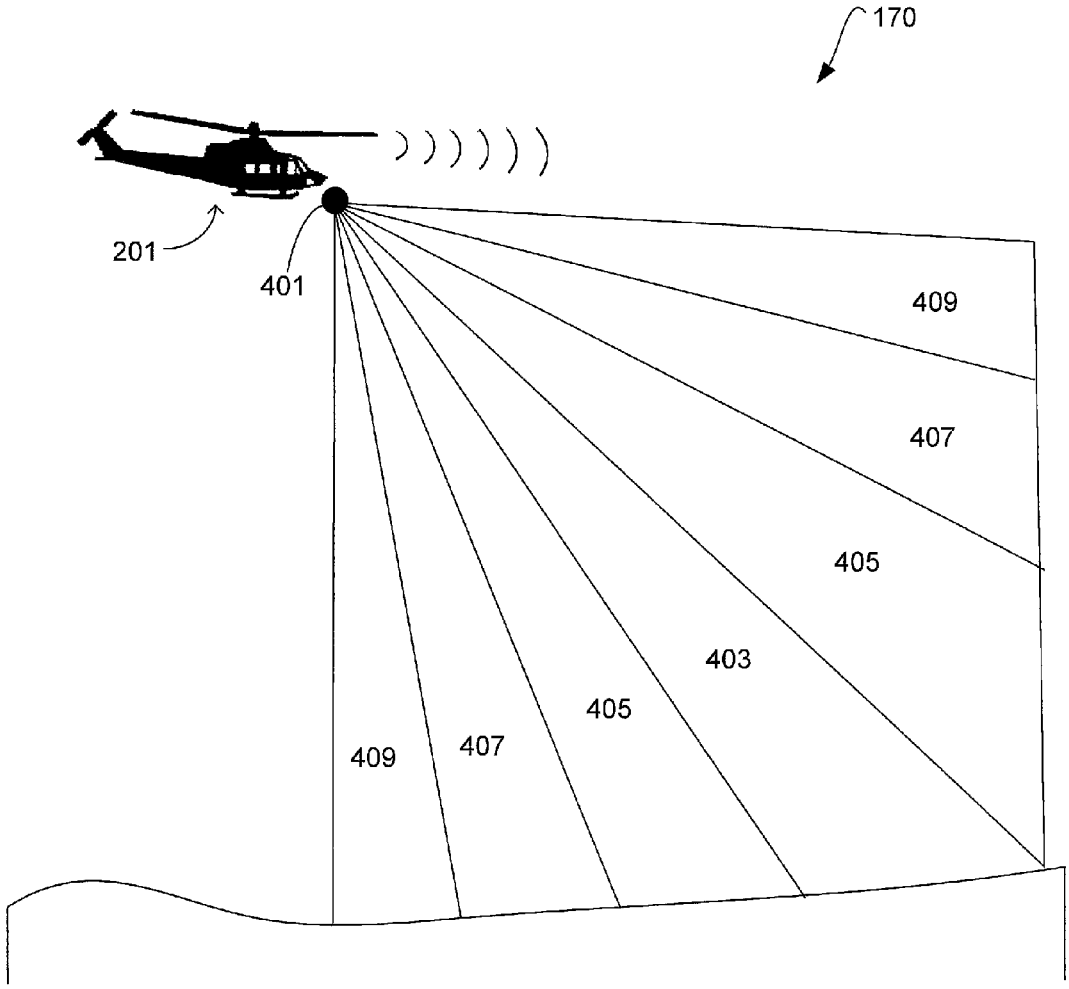
FIGS. 11 and 12 illustrate a cancellation area created by the acoustic signature reduction system of FIG. 2.
Figure 12:
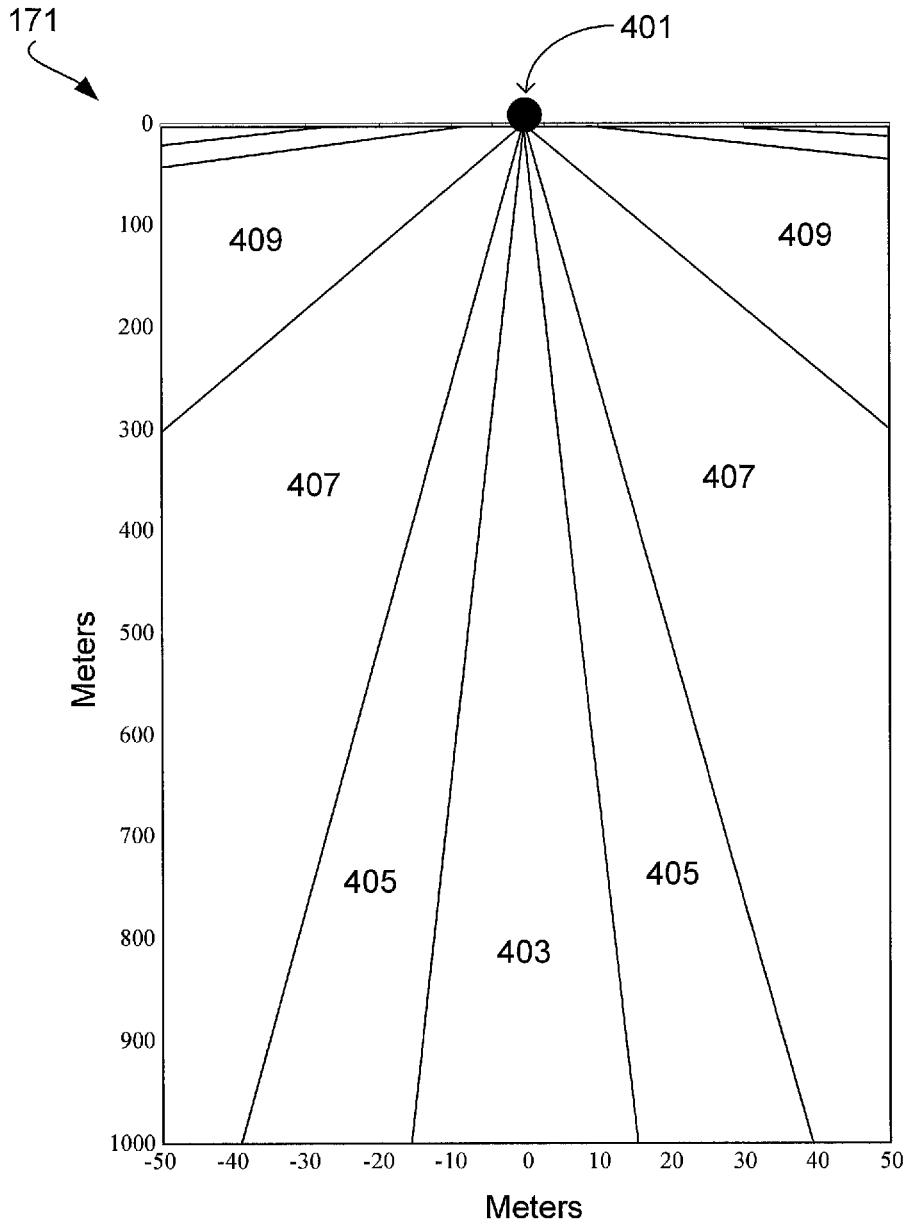

Referring now also to FIGS. 11 and 12 in the drawings, charts showing the noise cancellation effects of acoustic signature reduction system 101 are illustrated. Where multiple observers are positioned in different locations with respect to helicopter 201, the per-revolution timing, or phase of the compression noise is different between observers. For example, an observer located in front of helicopter 201 will hear the compression noise of a two-bladed helicopter 201 at different intervals than a second observer standing on the port side of the same helicopter 201. As the observer and/or helicopter 201 moves in relation to one another, the phase of the compression noise can also change with respect to the observer. This results in compression noise that is location dependent.

Acoustic signature reduction system 101 typically generates a cancellation noise in a set phase, or with certain timing, by using damping valve 115. The phase of the cancellation noise must be inverted and of equal amplitude to the compression noise in order to produce a phase cancellation. For signals to be inverted, the signals must be out of phase 180 degrees from the other signal. If the amplitudes are also equal, the amplitudes combine to cancel each other out. Acoustic signature reduction system 101 generates a cancellation noise that is relatively 180 degrees out-of-phase with the compression noise and of relatively equal amplitude, thereby reducing or canceling the acoustic signature relative to the compression noise. Because the compression noise is location dependent, the cancellation noise creates cancellation area 403 where the phase, amplitude, and frequency of the cancellation noise and compression noise operate to cancel each other out.

Chart 170 and chart 171 illustrate an example of variations in noise cancellation effects emanating from a single reference location 401 as seen in two views. Chart 171 is looking down on reference location 401 while chart 170 is looking at the side of reference location 401. Reference location 401 is representative of helicopter 201 as seen in chart 170. Two signals will be used to describe the cancellation effect. The two signals are the compression noise from rotor blades 207, 211 and the cancellation noise from acoustic signature reduction system 101. Because the timing, or phase, of the compression noise is location dependent, some locations around helicopter 201 experience a decrease in noise while others experience an increase in noise. As the phase of two signals moves away from 180 degrees out-of-phase, a partial reduction in noise or even an increase in noise will result.

Chart 171 illustrates the cancellation noise at 50 Hertz (Hz) in a side by side configuration. For purposes of illustration, it is assumed that the two signals are of equal amplitude and frequency. In cancellation area 403, the two signals are out-of-phase by 180 degrees thereby creating a complete cancellation of the sound. A reduction area 405 is shown on either side of cancellation area 403. Reduction area 405 results from having the two signals be slightly less than or greater than 180 degrees out-of-phase. In reduction area 405, the net effect of the two signals is a slight reduction of noise. A neutral area 407 is shown further away from cancellation area 403. Neutral area 407 occurs where the phase of the two signals combine to result in a net change of zero decibels. Beyond neutral area 407 is an increased area 409. Increased area 409 is the area in which the phase of the two signals is predominantly in phase with one another thereby resulting in a net increase in noise.

Cancellation effects vary in size the farther the sound travels from reference location 401 as seen in FIG. 12. Another feature of user interface 108 is the ability to allow the user to designate the size of cancellation area 403. Operational computer 110 is configured to display selected altitude and position data for helicopter 201 on user interface 108 to facilitate the required size of cancellation area 403. The pilot may then maneuver helicopter 201 to comply. In doing so, controller 107 permits flight plans to be created and/or modified to optimize flight paths while maintaining quiet operations with respect to cancellation area 403. Furthermore, controller 107 can communicate with the flight control computer of helicopter 201 such that the controller and flight control computer can alter the flight path of the aircraft without input from a pilot. For example, such an embodiment can be used with auto-pilot systems on helicopter 201 or with unmanned aerial vehicles, to name a few.

Referring back to FIG. 2 in the drawings, a forced air unit 117 is illustrated in acoustic signature reduction system 101. In order to change the direction of cancellation area 403, the phase of the cancellation noise would typically need to experience a phase shift. This phase shift could be done using forced air unit 117. Forced air unit 117 would be used to send bursts of air into thermo-acoustic tube 103 to adjust the phase of the cancellation noise. Operational computer 110 controls forced air unit 117 depending on signals from user interface 108 and inputs 106. Forced air unit 117 can also be used to force air into thermo-acoustic tube 103 if sufficient air is not entering thermo-acoustic tube 103. For example, slow forward movement of helicopter 201 may not allow sufficient air flow to reach the necessary amplitude or frequency required to cancel the compression noises. Furthermore, thermo-acoustic tube 103 may be oriented such that forward end 109 is not perpendicular to the flow of air during flight. Forced air unit 117 allows acoustic signature reduction system 101 to operate whether helicopter 201 is flying at any speed or is resting on the ground. Forced air unit 117 and damping valve 115 operate in conjunction to ensure proper air flow through thermo-acoustic tube 103.

Forced air unit 117 may be coupled to pipe 104 much the same was as described with damping valve 115. Furthermore, the location of forced air unit 117 is depicted as being coupled to forward end 109 of pipe 104 but it is understood that forced air unit 117 may be located at any location relative to pipe 104.

Another method of changing the direction of cancellation area 403 is to use multiple sets of thermo-acoustic tubes 103. Each set would be configured to "play" only in selected phases. In such a configuration, forced air unit 117 may not be required. However, this configuration would add more weight to helicopter 201.

Acoustic signature reduction system 101 is configured to operate with helicopter 201 to allow the pilot to designate a fixed or moving cancellation area 403. The pilot positions cancellation area 403 via user interface 108. Operational computer 110 then controls the phase and amplitude of the cancellation noise via damping valve 115 and forced air unit 117 to ensure that cancellation area 403 remains fixed as helicopter 201 moves. Furthermore, it is understood that acoustic signature reduction system 101 has the ability to permit a moving cancellation zone 403 as well. A moving cancellation are 403 is where cancellation area 403 independently moves with respect to helicopter 201.

Although the preferred embodiment illustrates power supply 105 as being wired to operational computer 110, it is understood that power supply 105 may be coupled to any device in acoustic signature reduction system 101 directly by using wires 119. It is further understood that alternate means of power may be used. In the preferred embodiment, power supply 105 is part of the existing systems located on helicopter 201. Power supply 105 may be independent from existing systems. Furthermore, one or more power supplies 105 may be used. Alternate sources of power may be used such as solar power, for example.

A screen 121 can be placed at any location within pipe 104 to prevent dirt, debris, and/or foreign objects from entering thermo-acoustic tube 103. Screen 121 would typically be placed at forward end 109 and/or aft end 111 but may be located in any location with respect to pipe 104. Screen 121 may be coupled to pipe 104 as a separate unit or in conjunction with that of forced air unit 117 or damping valve 115. For example, screen 121 could be placed around forward end 109 and be coupled to pipe 104 by threadedly connecting forced air unit 117 to forward end 109.

The present application provides significant advantages, including: (1) the ability to create high decibel and very-low frequency noises; (2) the ability to synchronize rotor blade compression noise with a cancellation noise device; (3) the ability to move a cancellation area around the helicopter; (4) system can be integrated into existing flight systems on an aircraft to save weight; and (5) acoustic signature reduction system can be installed in retrofit installations.

While the preferred embodiment has been described with reference to an illustrative embodiment, this description is not intended to be construed in a limiting sense. Various modifications and other embodiments of the invention will be apparent to persons skilled in the art upon reference to the description.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. An acoustic signature reduction system for an aircraft having a rotor blade compression noise, the system comprising:

a thermo-acoustic tube coupled to the aircraft, the thermo-acoustic tube having a pipe portion and one or more heating elements coupled to the pipe portion, each heating element being configured to heat air as the air flows through the pipe portion, thereby generating a cancellation noise; and a controller operably connected to the thermo-acoustic tube for selectively adjusting the frequency, amplitude, and phase of the cancellation noise to reduce the acoustic signature of the aircraft with respect to a selective cancellation area;

wherein the cancellation area moves relative to the aircraft during flight.

2. The acoustic signature reduction system of claim 1, wherein the aircraft is a plane, helicopter, tilt rotor aircraft, or unmanned aerial vehicle.

3. The acoustic signature reduction system of claim 1, wherein the thermo-acoustic tube has one or more bends.

4. The acoustic signature reduction system of claim 1, wherein the thermo-acoustic tube is coupled externally to the aircraft.

5. The acoustic signature reduction system of claim 1, wherein the thermo-acoustic tube is coupled internally to the aircraft.

6. The acoustic signature reduction system of claim 1, wherein the thermo-acoustic tube is rotatably coupled to the aircraft.

7. The acoustic signature reduction system of claim 1, wherein the thermo-acoustic tube has one or more open ends.

8. The acoustic signature reduction system of claim 1, wherein the heating element is moveable relative to the pipe portion.

9. The acoustic signature reduction system of claim 1, wherein the controller uses wireless communications to control the thermo-acoustic tube.

10. The acoustic signature reduction system of claim 9, wherein the controller is located remote to the aircraft, such that a person may access and control the thermo-acoustic tube without being on the aircraft.

11. The acoustic signature reduction system of claim 1, further comprising:

a damping valve coupled to the thermo-acoustic tube for synchronizing the cancellation noise generated by the thermo-acoustic tube with that of the rotor blade compression noise as heard by an observer relative to the aircraft.

12. The acoustic signature reduction system of claim 1, further comprising:

a forced air unit coupled to the thermo-acoustic tube for sending bursts of air into the thermo-acoustic tube to adjust the phase of the cancellation noise.

13. The acoustic signature reduction system of claim 1, further comprising:

a screen coupled to the thermo-acoustic tube for preventing dirt, debris, and foreign objects from entering the thermo-acoustic tube.

14. An acoustic signature reduction system for an aircraft, the system comprising:

a thermo-acoustic tube coupled to the aircraft, the thermo-acoustic tube including a heating element and a pipe portion, the thermo-acoustic tube being configured to generate a cancellation noise;

a damping valve coupled to the thermo-acoustic tube for synchronizing the cancellation noise generated by the thermo-acoustic tube with that of rotor blade compression noises as heard by an observer relative to the aircraft;

a forced air unit coupled to the thermo-acoustic tube for adjusting the phase of the cancellation noise;

a controller having a user interface in communication with the thermo-acoustic tube, the damping valve, and the forced air unit, such that one or more of the phase, amplitude, and frequency of the cancellation noise can be adjusted; and wherein the cancellation noise and rotor blade compression noise combine to produce a cancellation area wherein the rotor blade compression noise as heard by an observer is reduced;

wherein the controller continuously adjusts the cancellation noise during flight of the aircraft to maintain a reduced acoustic signature with respect to the cancellation area, the cancellation area moving with respect to the aircraft during flight.

15. The acoustic signature reduction system of claim 14, wherein the user interface is an interactive digital device that enables the pilot to graphically see the location of the aircraft in relation to other objects, so as to select the cancellation area.

16. The acoustic signature reduction system of claim 15, wherein the controller automatically adjusts one or more of the phase, amplitude, and frequency of the cancellation noise to compensate for relative motion between the aircraft and the cancellation area.

17. The acoustic signature reduction system of claim 14, wherein the controller permits flight plans to be created and modified to optimize flight paths, while maintaining a reduced acoustic signature with respect to the cancellation area.

18. A method of flying an aircraft with an acoustic signature reduction system, the method comprising:

entering a cancellation area in a controller;

generating a flight plan based on the location and size of the cancellation area, such that a reduced acoustic signature is maintained in the cancellation area;

flying the aircraft along a determined flight path according to the flight plan; and modifying the flight path based on data provided by the controller; and generating a cancellation noise through a thermo-acoustic tube, the cancellation noise being selectively directed to the cancellation area to reduce the acoustic signature of the aircraft, the cancellation area moving relative to the aircraft during flight.

19. The method as in claim 18, wherein the controller monitors and adjusts one or more of the phase, frequency, and amplitude of a cancellation noise as the aircraft moves relative to the cancellation area.

20. The method as in claim 18, wherein the controller is incorporated into a flight control computer of the aircraft, such that the controller and flight control computer alter the flight plan of the aircraft without input from a pilot.

* * * * *